United States Patent [19]

Bridgewater

[11] Patent Number: 4,932,079

[45] Date of Patent: Jun. 12, 1990

[54] GARMENT SUPPORTER

[76] Inventor: Paul Bridgewater, 23935 W. Outer Drive Apt. D7, Melvindale, Mich. 48122

[21] Appl. No.: 382,438

[22] Filed: Jul. 19, 1989

Related U.S. Application Data

[63] Continuation-in-part of Ser. No. 236,705, Aug. 22, 1988, abandoned, which is a continuation-in-part of Ser. No. 202,247, Jun. 6, 1988, abandoned.

[51] Int. Cl.[5] ..... A41F 9/02

[52] U.S. Cl. ..... 2/313; 2/320; 128/99.1; 128/101.1; 128/155; 450/100

[58] Field of Search ..... 2/313, 305, 308, 310, 2/320, 311; 128/95,1, 96.1, 99.1, 100.1, 101.1, 134, 135, 155, 156, 161, 163; 450/100

[56] References Cited

U.S. PATENT DOCUMENTS

| | | | |
|---|---|---|---|
| 567,343 | 9/1896 | Harden | 128/161 |
| 1,683,691 | 9/1928 | Mulock | 2/320 |
| 1,830,302 | 11/1931 | Townsend | 2/308 |
| 3,021,838 | 2/1962 | Fine | 128/100.1 |
| 4,501,026 | 2/1985 | Seneca | 2/308 |

*Primary Examiner*—H. Hampton Hunter
*Attorney, Agent, or Firm*—Joseph W. Farley

[57] ABSTRACT

A garment supporter comprising a belt and an affixed harness the functional purpose of which is to maintain the position of an upper torso garment on the body of a wearer. The belt encircles the torso and the outer surface of the lower portion of such a garment, has at least one slip resistant surface engageable therewith, and thereby maintains its own position in relation to the garment. The harness is connected to the rear of the belt, extends through the crotch, is again connected to the front of the belt, and thereby maintains the position of the belt and the position of the garment relative to the body of the wearer.

7 Claims, 5 Drawing Sheets

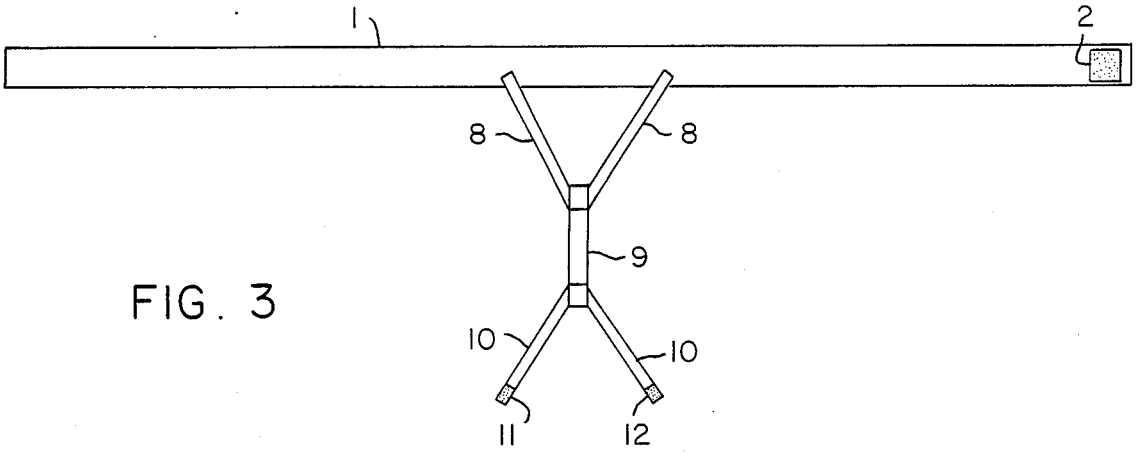
FIG. 3
FIG. 4
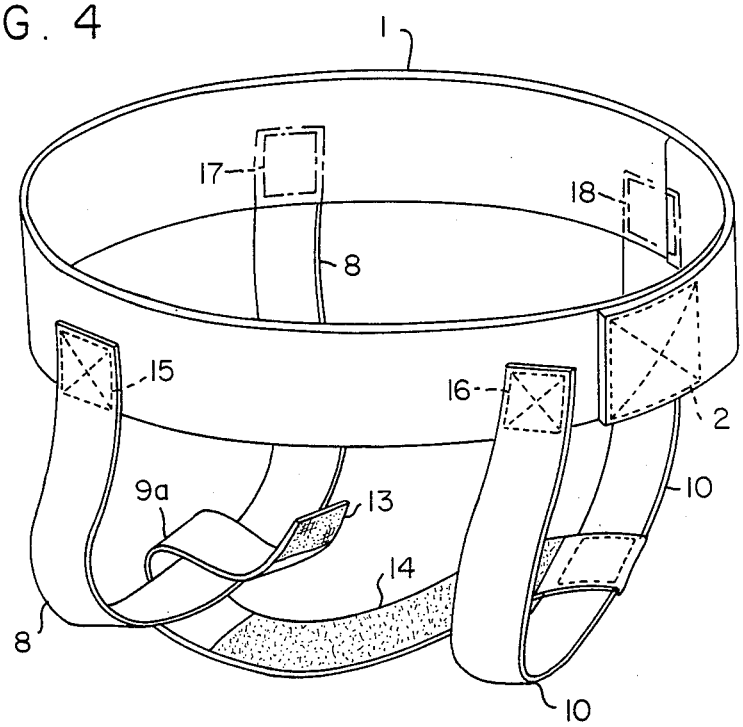

GARMENT SUPPORTER

RELATED APPLICATIONS

This application is a continuation-in-part of prior copending application Ser. No. 07/236,705, filed Aug. 22, 1988 now abandoned, which was in turn a continuation-in-part of application Ser. No. 07/202,247 filed June 6, 1988 and now abandoned.

TECHNICAL FIELD

The present invention relates to garment supporters which utilize friction, either solely or in part to support garments. More specifically, the present invention is a belt and an affixed harness, the functional purpose of which is to support shirts, blouses, sweaters, lingerie, and the like, hereafter referred to as upper torso garments.

BACKGROUND ART

With the objective of relieving mankind of the burden associated with frequently tucking upper torso garments into the pants or skirt, the present invention was created. Prior to the present invention, remedies to the problem of maintaining the position of upper torso garments included devices comprising relatively small gripping pads sewn to elastic waistbands consisting of several plies of various elastic materials, and slip resistant waistbands with stiffners to prevent rolling.

The forementioned remedies were plagued by one or more of the following deficiencies. The use of such said devices was contingent upon the wearing of pants or a skirt, lower torso garments, in which the devices were sewn. The adjustability of such devices was limited in that they were attached to the waistband of lower torso garments. Such devices relied upon either lower torso garments or mere waistband tautness to maintain their own position.

This invention, when applied to its functional purpose, is totally independent of lower torso garments, has infinite adjustability within a broad size range, is physically constructed to deter rolling of its waistband, and maintains its own position as worn with little variation regardless of the pull by street clothes worn therewith.

DISCLOSURE OF INVENTION

The present invention provides a garment supporter comprising a belt and an affixed harness constructed of softly stretchable and highly slip resistant material. Said belt encircles the lower torso area of the body and the lower part of an upper torso garment, forcing the garment against the body. The combination of force due to the tautness of the belt, the friction due to the slip resistant surface of the belt, enables said belt to maintain its own position in relation to the garment.

Said harness is affixed to the rear section of the belt which covers the pelvis area of the body, spans the crotch, and then extends and is fastened to the front section of the belt, which covers the lower abdomenal area of the body. The harness insures that the belt maintains its own position in relation to the body.

The combined effects of the belt and harness, thus the present invention, constitute a garment supporting device which meets the following objectives:

To maintain the position of upper torso garments as worn, and during moderate to strenuous activity;

To maintain its own position independently of garments worn therewith, including deterrence to rolling of said belt;

To be wearable with street clothes without creating a bulky or cumbersome appearance, while meeting the requirements of comfort, lightweight, quick securability and release, and durability; and, To provide the capability of adjustment within a broad size range.

The garment supporting device of present invention is such that it may be concealed by street clothes which cover the lower part of the body, i.e. pants, skirt, etc.

DESCRIPTION OF THE DRAWINGS

FIG. 3 is an inside plan view of a modified device of the present invention having a harness constructed of multiple straps affixed to the belt with connection means;

FIG. 4 is a perspective view of a further modification of the invention having a harness with an adjustable crotch fitting strap;

BEST MODES FOR CARRYING OUT THE INVENTION

Figure 1:
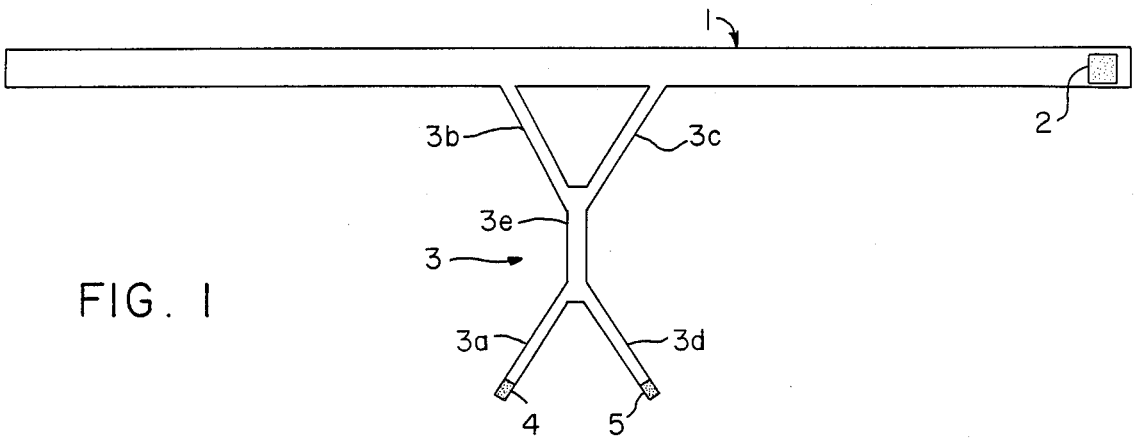
FIG. 1 is an inside plan view of a garment supporting device of the invention having a harness with integral portions.
Figure 2:
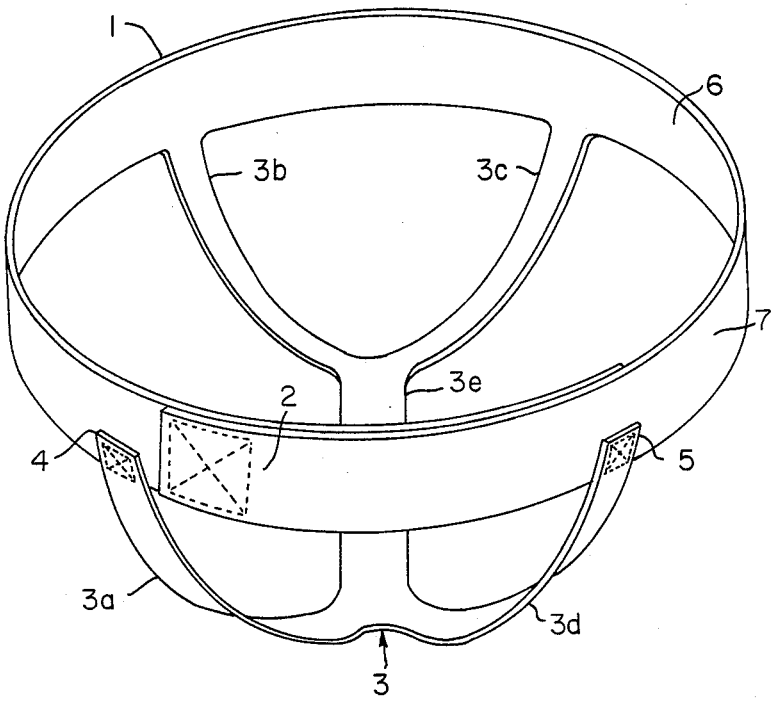
FIG. 2 is a perspective view of the device of FIG. 1 as fastened.

Referring now to the drawings, where like numerals refer to like elements throughout, the present invention as shown in FIG. 1 and FIG. 2 comprises a torso and garment encircling belt 1 having a fastener 2 and an affixed crotch fitting harness 3 having fasteners 4, 5, which fasteners may be the "Velcro" type. The belt 1 is constructed of softly stretchable highly slip resistant material such as foam rubber, rubberized fabric, or the like. The elasticity of the belt 1 increases its adjustability above that which the fastener 2 provides. The inner surface 6 of the belt 1 provides the friction which combines with the tautness of the belt 1 to keep the belt 1 in position in relation to an upper torso garment when the belt 1 is applied by the wearer of such a garment over the outer surface thereof.

In FIG. 2 the outer surface 7 of the belt 1 may be treated with a textile or other materials to conceal the high friction surface, provide for ornamental design, or in cases of suitable treatments provide for the reception of a variety of types of fasteners including but not limited to Velcro. I have found that a stretchable belt serves very effectively; however, any material suitable for a belt wherein a slip resistant surface is incorporated or attached will serve the purpose.

FIG. 1 and FIG. 2 show the harness 3 having integral portions 3*a*, 3*b*, 3*c*, 3*d*, 3*e* constructed of material which is uniform and consistent with the belt 1. In this species, the device of the present invention exists as a singular piece of form rubber or similar material punched, stamped, or cut into the desired shape and size. Fasteners 4, 5 are affixed with thread or other means to the detachable ends of the harness portions *3a*, *3d*.

Another species of the present invention shown in FIG. 3 incorporates a harness constructed of two straps 8, 10 of dissimilar material and one strap 9 of similar material to the belt 1 or any combination of similar and dissimilar materials. The straps 8, 10 are joined to strap 9 at their midpoints and are fastened thereto by thread or other means. Velcro or other fasteners 11, 12 are affixed by thread or other means to the free ends of straps 10 to allow for detachable connection of the harness to the belt 1. The ends of strap 8 are affixed by thread or other means to the belt 1.

A third species of the present invention shown in FIG. 4, employs a strap *9a* to provide adjustment between the straps 8 and 10. In this instance, strap *9a*, which forms a loop around strap 8, is fastened at one end to strap 10 by thread or other means. The other end of strap *9a* incorporates on its face a portion 13 of a Velcro or other fastener for connection to another portion 14 of the fastener also provided on the face of *9a* at a desired position lengthwise thereof. The effective length of strap *9a* is determined by the variable point of connection of fastener 13, 14. The spacing between straps 8 and 10 is determined by the effective length of strap *9a*. The spacing between straps 8 and 10 may be varied to achieve a desired snug fit of the harness on the body of the wearer. The harness in FIG. 4 attaches to belt 1 at front and rear with Velcro or other fasteners 15, 16, 17, 18.

Figure 5:
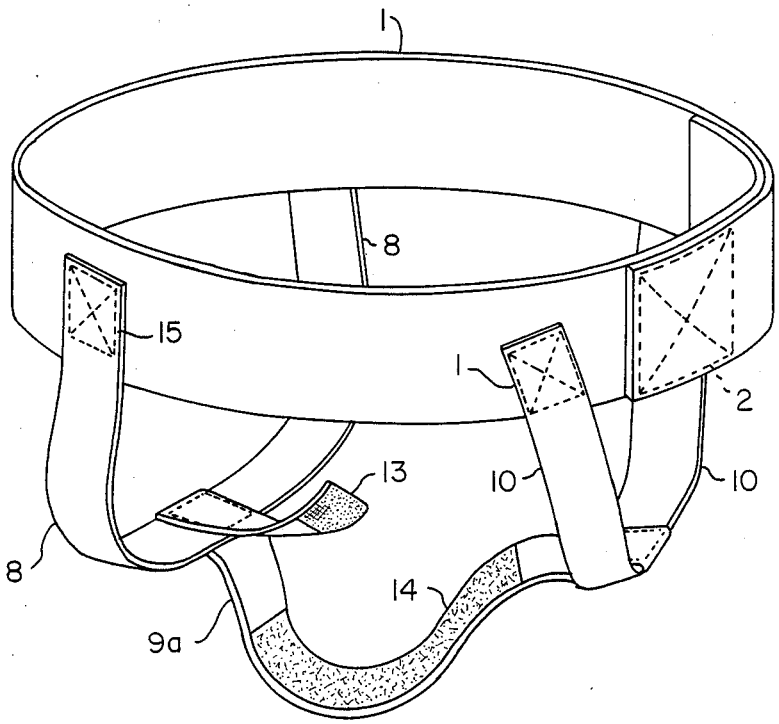
FIG. 5 is a perspective view of an alternative arrangement of the harness of FIG. 4.

Additionally, the strap *9a* may be fastened by thread or other means to the strap 8 to provide a link between straps 8 and 10 when the fastener 13, 14 is disengaged as shown in FIG. 5.

Figure 6:
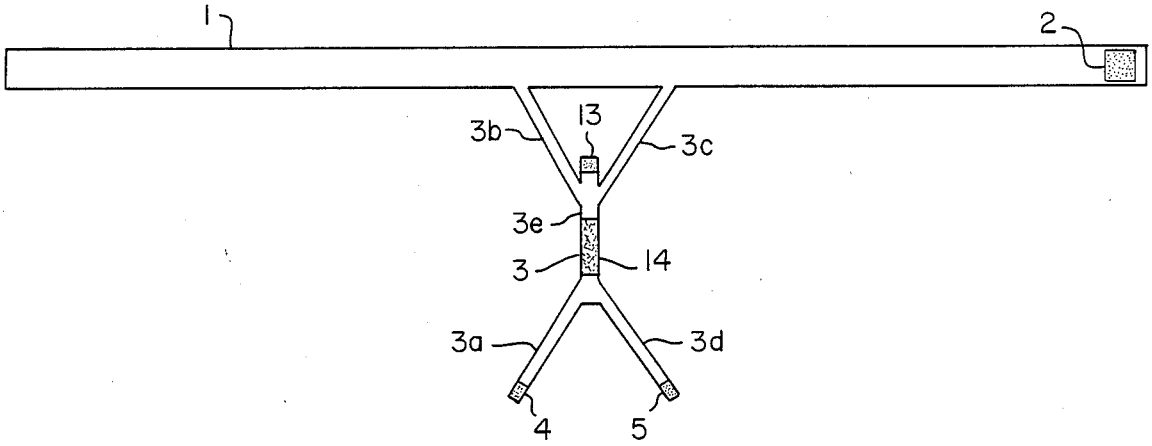
FIG. 6 is an inside plan view of the device of FIG. 1 having a harness with integral portions and an adjustable crotch fitting strap.

FIG. 6 shows a species of the invention with a harness having integral portions and an adjustable crotch fitting strap.

Figure 7:
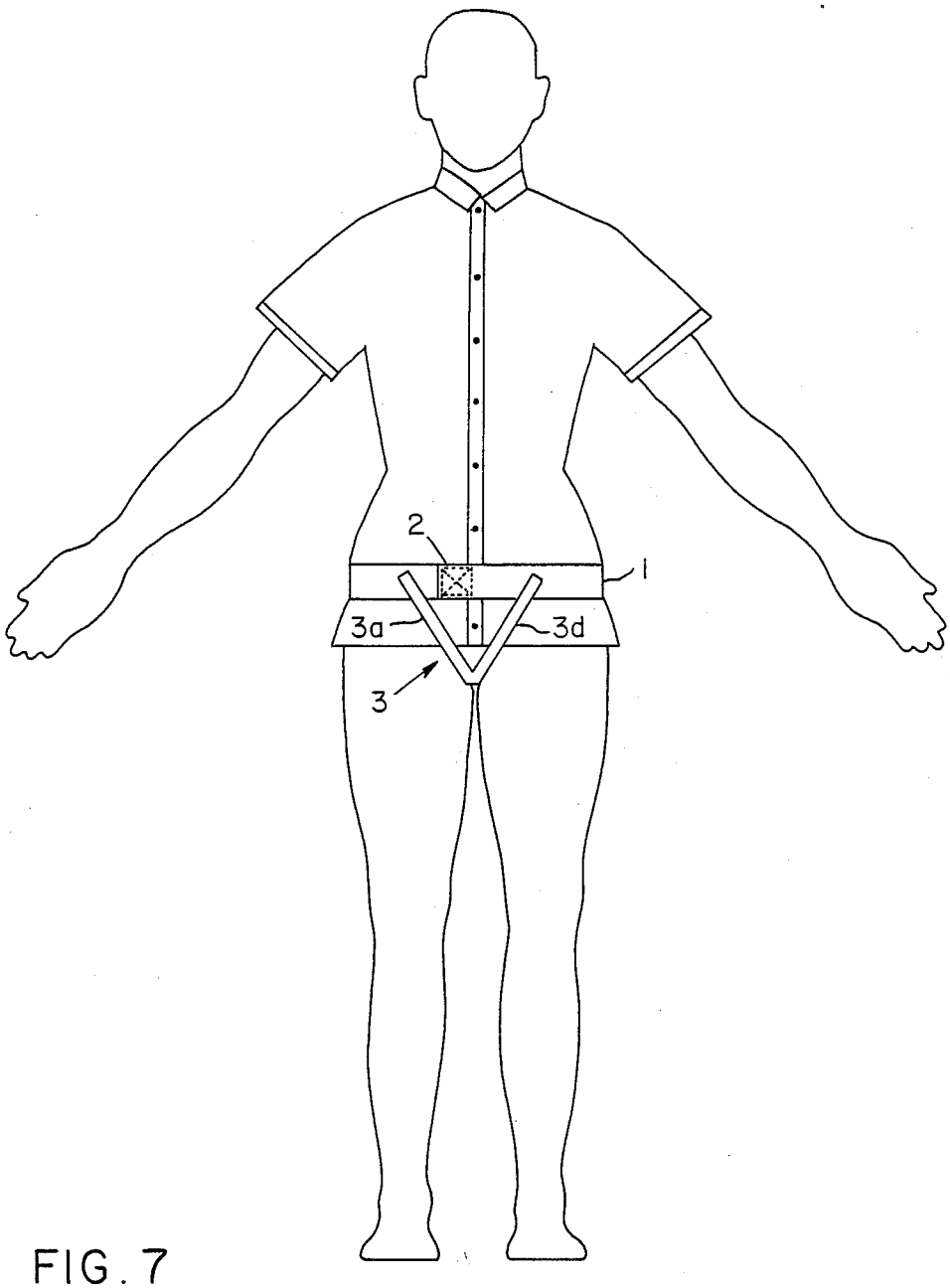
FIG. 7 is a front view of a device of the present invention as worn.
Figure 8:
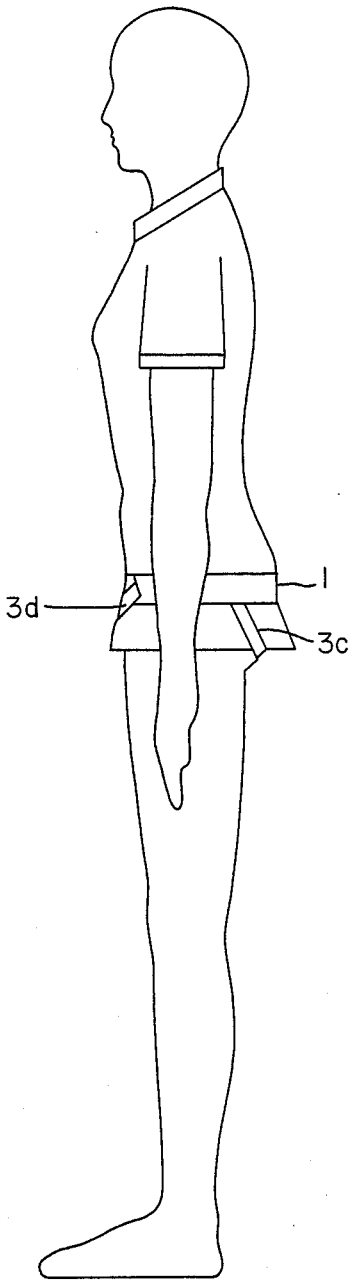
FIG. 8 is a side view of a device of the present invention as worn.

FIG. 7 and FIG. 8 show the invention as worn.

The harness of each embodiment opposes the upward pull by an upper torso garment, which causes spreading rather than rolling of the belt. The thickness and softness of the members comprising the garment supporting device of the present invention allow it to be concealed under street clothes without creating a bulky or cumbersome appearance while permitting material durability to be retained. Although all fasteners within this application are identified as Velcro, other fasteners will serve my purpose.

It is apparent from the foregoing description that each embodiment of the invention is adapted to be worn by a user over the outer surface of an upper torso garment, the belt 1 encircling the garment preferably below the wearer's waistline and being maintained in proper garment engaging position by the harness. Also, the foregoing description is considered illustrative of only the priciples of the invention, which can be made in various forms within the scope of the following claims.

I claim:

1. A garment supporter for maintaining an upper torso garment in a desired draped position on the body of a wearer of said garment, comprising belt means adapted to encircle a lower portion of the outer surface of said garment and having at least one slip resistant surface engageable therewith, body engageable harness means for maintaining said belt means in a desired garment and torso encircling position at substantially the waist area of the wearer, said harness means comprising interconnected front and rear strap means respectively engaging said belt means at a plurality of spaced locations at each of front and rear portions of the torso, and means for detachably connecting said strap means to said belt means in at least one of said spaced front and rear locations whereby said harness means is operable to oppose upward pull on said belt means by said garment.

2. A garment supporter according to claim 1, wherein said harness means comprises integral portions likewise being integral with said belt means.

3. A garment supporter according to claim 2, further comprising fastening means connected to said integral portions of said harness means for varying the positions thereof.

4. A garment supporter according to claim 1, wherein said harness means includes a crotch-fitting strap portion interconnecting said front and rear strap means.

5. A garment supporter according to claim 4, wherein said harness means includes front and rear straps each adapted to extend between one of said spaced front and rear locations, said crotch-fitting strap portion connecting said front and rear straps.

6. A garment supporter according to claim 5, wherein said crotch-fitting strap portion is provided with adjustable fastening means.

7. A garment supporter for maintaining an upper torso garment in a desired position on the body of a wearer of said garment, comprising belt means adapted to encircle a lower portion of the outer surface of said garment and having at least one slip resistant surface engageable therewith, and body engageable harness means for maintaining said belt means in a desired garment and torso encircling position at substantially the waist area of the wearer, said harness means comprising interconnected front and rear strap means respectively engaging said belt means at each of front and rear portions of the torso whereby said harness means is operable to oppose upward pull on said belt means by said garment.

* * * * *